US010037828B2

(12) United States Patent
Lee et al.

(10) Patent No.: US 10,037,828 B2
(45) Date of Patent: Jul. 31, 2018

(54) STORAGE CONTAINER FOR SPENT NUCLEAR FUEL

(71) Applicant: KOREA ATOMIC ENERGY RESEARCH INSTITUTE, Daejeon (KR)

(72) Inventors: Chan Bock Lee, Daejeon (KR); Jun Hwan Kim, Daejeong (KR); Jin-Sik Cheon, Daejeon (KR)

(73) Assignee: KOREA ATOMIC ENERGY RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 15/621,570

(22) Filed: Jun. 13, 2017

(65) Prior Publication Data

US 2017/0365367 A1 Dec. 21, 2017

(30) Foreign Application Priority Data

Jun. 21, 2016 (KR) ..... 10-2016-0077351

(51) Int. Cl.

| | |
|---|---|
| ***G21F 5/10*** | (2006.01) |
| ***G21F 5/008*** | (2006.01) |
| *G21F 5/005* | (2006.01) |
| *G21F 5/06* | (2006.01) |

(52) U.S. Cl.

CPC ..... *G21F 5/10* (2013.01); *G21F 5/008* (2013.01); *G21F 5/005* (2013.01); *G21F 5/06* (2013.01); *G21Y 2002/104* (2013.01); *G21Y 2002/60* (2013.01); *G21Y 2004/10* (2013.01); *G21Y 2004/302* (2013.01); *G21Y 2004/601* (2013.01)

(58) Field of Classification Search

CPC ..... G21F 5/002; G21F 5/005; G21F 5/008; G21F 5/06; G21F 5/015; G21F 5/10; G21F 5/12; G21F 5/14; G21Y 2002/104; G21Y 2002/60; G21Y 2004/10; G21Y 2004/302; G21Y 2004/601

See application file for complete search history.

(56) References Cited

U.S. PATENT DOCUMENTS 4,115,311 A * 9/1978 Sump ..... G21F 9/36 419/11
4,491,540 A * 1/1985 Larker ..... G21F 9/36
(Continued)

FOREIGN PATENT DOCUMENTS

| | | |
|---|---|---|
| EP | 1 096 507 B1 | 1/2006 |
| JP | 4461080 | 5/2010 |
| KR | 10-2007-0034173 | 3/2007 |

OTHER PUBLICATIONS https://www.webelements.com/copper/isotopes.html.*

*Primary Examiner* — David E Smith
(74) *Attorney, Agent, or Firm* — Klarquist Sparkman, LLP

(57) ABSTRACT

The present invention provides a dry interim storage container for spent nuclear fuel, precisely a dry interim storage container that can be filled with spent nuclear fuel wherein the storage container space is also filled with metal particles. The dry storage container for spent nuclear fuel of the present invention is filled with particles in its empty space for the spent nuclear fuel, which is advantageous in cooling efficiency and maintenance cost, compared with the conventional storage method using gas.

20 Claims, 5 Drawing Sheets

(56) References Cited

U.S. PATENT DOCUMENTS

| | | | | |
|---|---|---|---|---|
| 2005/0157833 | A1* | 7/2005 | Ishihara | G21F 1/103<br>376/272 |
| 2005/0224729 | A1* | 10/2005 | Tamaki | G21F 5/00<br>250/507.1 |
| 2008/0069291 | A1* | 3/2008 | Singh | G21F 5/005<br>376/272 |

* cited by examiner

FIG. 3

| Element | Mass number(Element with highest abundance is set 0) | | | | | | |
|---|---|---|---|---|---|---|---|
| | -3 | -2 | -1 | 0 | 1 | 2 | 3 |
| B | | | 19.9% | 80.1% | β-decay (20.2msec) | | |
| C | | | | 98.9% | 1.07% | β-decay (5.71e3yr) | |
| Mg | | | | 78.9% | 10% | 11.1% | β-decay (9.5min) |
| Al | | | | 100.0% | β-decay (2.24min) | | |
| Si | | | | 92.2% | 4.7% | 3.1% | β-decay (2.62hrs) |
| Ti | | 8.3% | 7.4% | 73.7% | 5.4% | 5.2% | β-decay (5.76min) |
| V | | | | 99.7% | β-decay (3.7min) | | |
| Cr | | 4.3% | | 83.7% | 9.5% | 2.4% | β-decay (3.49days) |
| Mn | | | | 100.0% | β-decay (2.57hrs) | | |
| Fe | | 5.8% | electron capture | 91.7% | 2.1% | 0.3% | β-decay (44.5days) |
| Ni | | | | 68.1% | β+decay (1.01e5yrs) | 26.2% | 1.1% |
| Cu | | | | 69.2% | β-,+decay (12.7hrs) | 30.8% | β-decay (5.1min) |
| Zn | | | | 49.2% | ε decay (244days) | 27.7% | 4.0% |
| Y | | | | 100.0% | β-decay (2.66days) | | |
| Zr | | | | 51.5% | 11.2% | 17.2% | β-decay (1.53e6yrs) |
| Nb | | | | 100.0% | β-decay (2.03e4yrs) | | |
| Mo | 15.9% | 16.7% | 9.6% | 24.1% | β-decay (2.7days) | | |
| Hf | 18.6% | 27.3% | 18.6% | 35.1% | β-decay (42.4days) | | |
| Ta | | | | 100.0% | α, β-decay (114.4days) | | |

STORAGE CONTAINER FOR SPENT NUCLEAR FUEL

This application claims priority to KR Patent Application No. 10-2016-0077351 filed on Jun. 21, 2016. The disclosure of that prior filed application is incorporated herein by reference.

BACKGROUND OF THE INVENTION

1. Field of the Invention

The present invention provides a dry interim storage container for spent nuclear fuel.

2. Description of the Related Art

The spent nuclear fuel generated in light water reactors and heavy water reactors is stored in interim storage before permanent disposal. The spent nuclear fuel produces high radiation and heat due to the decay of the instable or radioactive fission products over the time. The spent nuclear fuel discharged from the reactor of the nuclear power plant after the irradiation is stored in a water bath for cooling decay heat and neutron shield in the site of the nuclear power plant for a certain period. The spent nuclear fuel, which has been stored for a while and whose radiation level and temperature have dropped below a certain level, is drawn out and stored dry in a concrete or metal storage container.

In the case of temporary storage in the site of the nuclear power plant, the spent nuclear fuel is stored for about 30-50 years. When the spent nuclear fuel is stored in the interim storage, it may be kept for up to 100-300 years or longer, before final disposal. The interim storage container for spent nuclear fuel may be also transported to the other place, if needed, while maintaining the integrity of both the container and the spent nuclear fuels inside the container. Therefore, it is important to secure the long term soundness of the spent nuclear fuel to be stored, and it is necessary to efficiently transfer the heat of the spent nuclear fuel, which is generated by decay heat, to the outside.

As an example of the prior art for casks to store the spent nuclear fuel, Korean Patent No. 10-0727092 describes a technique to provide a waste container containing silver or silver compound for the spent nuclear fuel. According to the art above, when the container containing the spent nuclear fuel is damaged, the container is effective in reducing the amount of radioactive iodine discharged therefrom.

However, in the prior art, the inert gas helium (He) is charged into the storage container as a coolant during dry storage, wherein the He pressure is regulated as approximately 4 bar for cooling the spent nuclear fuel during storage. When an inert gas is filled in container, extra management cost is required to prevent leakage and to maintain the pressurized condition with monitoring. In addition, in that case, the coolant used there is a gas having low thermal conductivity so that it is not a very efficient coolant for the spent nuclear fuel to get a sufficient degree of cooling, suggesting that it is difficult to secure the long term soundness of the spent nuclear fuel.

To overcome the disadvantages of the prior art, the present inventors studied and developed an interim storage container for the spent nuclear fuel, which is filled with metal particles with high thermal conductivity as much as the spent nuclear fuel and the outer wall of the storage room are contacted with them, in order to eliminate the decay heat generated from the spent nuclear fuel efficiently, leading to the completion of the present invention.

PATENT REFERENCE (Patent Reference 1) Korean Patent No. 10-0727092

SUMMARY OF THE INVENTION

It is an object of the present invention to provide a storage container for spent nuclear fuel that effectively delivers the decay heat of spent nuclear fuel out of the container and satisfies low maintenance costs and long term soundness.

To achieve the above object, the present invention provides an interim storage container for spent nuclear fuel which is filled with metal particles in the storage room for the storage of spent nuclear fuel.

The present invention provides an interim storage container for spent nuclear fuel comprising:

a cylindrical body;

an inner container having multiple storage rooms for spent nuclear fuel that is located in the inside of the main body;

a cylindrical outer shell equipped in the outside of the main body;

a neutron shielder to block the neutrons located in between the main body and the outer shell; and a lid connected to the top of the main body, and containing metal particles in the storage room for spent nuclear fuel.

Further, the present invention provides a method for cooling the spent nuclear fuel during the period of interim storage comprising the following steps:

preparing an interim storage container for spent nuclear fuel composed of a cylindrical body; an inner container having multiple storage rooms for spent nuclear fuel that is located in the inside of the main body; a cylindrical outer shell equipped in the outside of the main body; a neutron shielder to block the neutrons located in between the main body and the outer shell; and a lid connected to the top of the main body (step 1); and filling the empty sections in the storage room with metal particles before, during or after loading the spent nuclear fuel in the storage room of the container prepared in step 1 (step 2).

Advantageous Effect

The dry storage container for spent nuclear fuel of the present invention is filled with particles when the spent nuclear fuel is stored, so that the cooling efficiency is higher than the conventional method using gas coolant at high pressure. The accident scenario of overheating of the spent fuel due to leakage of high pressure gas coolant from the conventional dry storage container can be inherently eliminated by filling the particles inside the container. Before disposal of the spent nuclear fuel, particles filling the dry storage container can be recovered and re-used for other dry storage containers. Particles inside the container can also function as both the radiation shield and the buffer against impact during transportation of the dry storage container.

BRIEF DESCRIPTION OF THE DRAWINGS

The application of the preferred embodiments of the present invention is best understood with reference to the accompanying drawings, wherein:

FIG. 3 is a table illustrating the isotope distribution and radioactive characteristics of metal particle elements;

DESCRIPTION OF THE PREFERRED EMBODIMENTS

Figure 1:
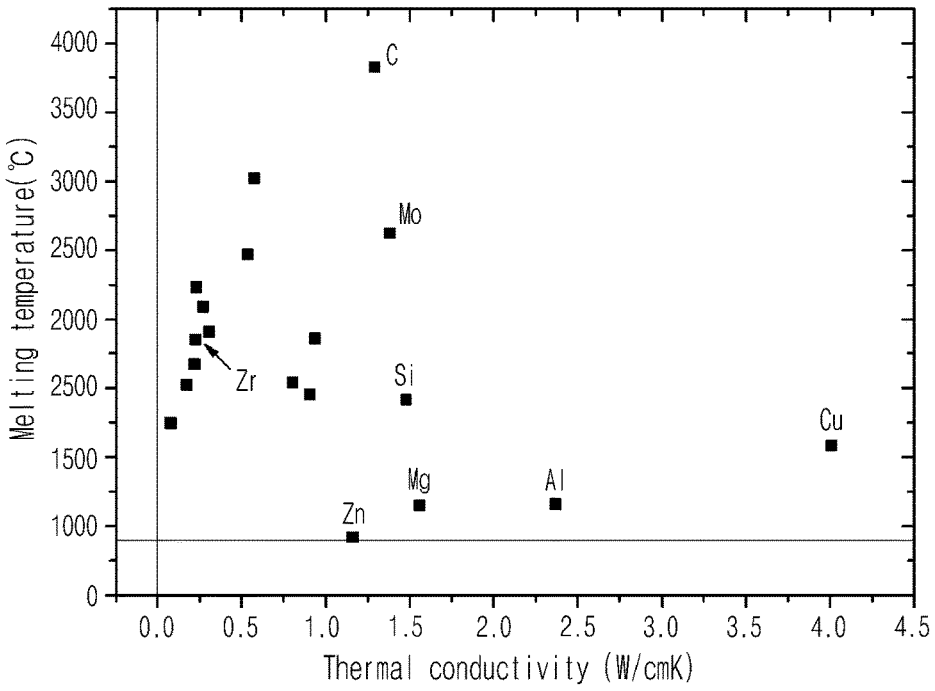
FIG. 1 is a graph illustrating the thermal conductivity and the melting temperature of metal particle elements.

Hereinafter, the present invention is described in detail.

The present invention provides an interim storage container for spent nuclear fuel which is filled with metal particles in the storage room for the storage of spent nuclear fuel.

Hereinafter, the interim storage container for spent nuclear fuel of the present invention is described in more detail.

The interim storage container for spent nuclear fuel of the present invention is characteristically filled with metal particles in the storage room where the spent nuclear fuel or the spent nuclear fuel aggregate is stored.

The dry storage container for spent nuclear fuel generally used as the interim storage for spent nuclear fuel can be composed of an inner container having multiple storage rooms where the spent nuclear fuel is stored and an outer container covering the inner container. In this invention, the storage rooms where the spent nuclear fuel is stored are filled with metal particles.

The metal particles herein are filled in the empty space of the storage rooms where the spent nuclear fuel is stored, and in particular the metal particles are preferably filled in contact with the outer side of the spent nuclear fuel.

In the interim storage container for spent nuclear fuel of the present invention, the metal particle can be one or more metals selected from the group consisting of boron (B), carbon (C), magnesium (Mg), aluminum (Al), silicon (Si), titanium (Ti), vanadium (V), chromium (Cr), manganese (Mn), iron (Fe), nickel (Ni), copper (Cu), zinc (Zn), yttrium (Y), zirconium (Zr), niobium (Nb), molybdenum (Mo), hafnium (Hf), tantalum (Ta), gold (Au), silver (Ag), platinum (Pt), and the alloys thereof, and more preferably the metal particle is selected from the group consisting of copper (Cu), zinc (Zn), aluminum (Al), magnesium (Mg), molybdenum (Mo), silicon (Si), carbon (C), zirconium (Zr), and the alloys thereof.

The particle size of the metal particle is preferably 0.1 mm-10 mm, more preferably 0.5 mm-5 mm, and most preferably 1 mm-3 mm. If the particle size of the metal particle is less than 0.1 mm, there is a problem that the economic efficiency is low due to the additional cost for particle processing. If the particle size exceeds 10 mm, the cooling efficiency is reduced due to the coarse particles.

For more efficient cooling, the storage room can be filled with particles with even particle size (substantially the same size particles), but more preferably filled with particles with different particle sizes. Particularly, metal particles with the particle size of 0.1 mm-1 mm are mixed together with those particles with the particle size of 1 mm-10 mm. In that case, more efficient cooling can be achieved by locating the metal particles having smaller particle size in between the metal particles having bigger particle size.

The metal particle in this invention can for example be spherical or polyhedral. To accomplish more efficient cooling by decreasing the fraction of empty spaces that can reduce the thermal conductivity in the course of filling the metal particles, it is preferred for the metal particle to be in the form of sphere or polyhedron. Considering the economic efficiency accomplished by reducing the weight of the particle, the metal particle can be in the form of solid or hollow. The size and the hollow structure of the filling metal particles are determined by evaluating the temperature distribution and heat transfer characteristics of the storage container for spent nuclear fuel.

Further, the thermal conductivity of the metal particle is preferably at least 1.0 W/cm·K, more preferably 1.0 W/cm·K-10.0 W/cm·K, and most preferably 1.2 W/cm·K-4.2 W/cm·K. The thermal conductivity has to be considered to efficiently cool the decay heat generated from the spent nuclear fuel filled in the empty space of the storage room for spent nuclear fuel. If the thermal conductivity of the metal particle is less than 1.0 W/cm·K, the decay heat generated from the spent nuclear fuel cannot be cooled down efficiently.

In addition, considering the long term storage of the spent nuclear fuel at a high temperature, the thermal stability of the metal particle filling in has to be considered. For example, the melting point is one factor to be considered. The melting point of the metal particle in this invention is preferably at least 500° C., and more preferably 500° C.-4000° C. Also, the metal particle is expected not to be changed in its phase at a temperature under the melting point. When the metal particle having a single phase without phase transformation at a temperature under the melting point is used, it can provides uniform cooling performance without physical property changes according to the long term storage.

Further, the neutron absorption rate of the metal particle is preferably $1\times10^4$ neutron/cm-2 neutron/cm, and more preferably $2\times10^4$ neutron/cm-1 neutron/cm. Considering the characteristics of the spent nuclear fuel emitting neutrons and radiation, the degree of radio-activation of the metal particle is also an important factor to be considered. If the radio-activation caused by the emitted neutrons is excessive, the metal particles to be filled are treated as separate radioactive waste, which increases the amount of waste. However, when it is necessary to prevent the nuclear criticality of the spent nuclear fuel, it is possible to add an element that absorbs neutrons such as boron (B) to the metal particle material.

In addition, when the metal particle material absorbs neutrons, the atomic mass increases and could become unstable, and decay with radiation emission. To reduce the possibility of radioactivation, it is preferable that the atomic mass of stable isotopes of metal particle element is 0~3 higher than that of the reference isotope (an isotope having the highest existence ratio) of the element having a high presence ratio. Then, the element of the metal particles can be still stable even after absorbing neutrons.

The present invention also provides an interim storage container for spent nuclear fuel comprising:

a cylindrical body;

an inner container having multiple storage rooms for spent nuclear fuel that is located in the inside of the main body;

a cylindrical outer shell equipped in the outside of the main body;

a neutron shielder to block the neutrons located in between the main body and the outer shell; and a lid connected to the top of the main body, and containing metal particles in the storage room for spent nuclear fuel.

Hereinafter, the interim storage container for spent nuclear fuel of the present invention is described in more detail.

The interim storage container for spent nuclear fuel of the present invention comprises a cylindrical body; an inner container having multiple storage rooms for spent nuclear fuel that is located in the inside of the main body; a cylindrical outer shell equipped in the outside of the main body; a neutron shielder to block the neutrons located in between the main body and the outer shell; and a lid connected to the top of the main body; and characteristically includes the metal particles filled in the storage room for the spent nuclear fuel.

The metal particles herein are filled in the empty space of the storage rooms where the spent nuclear fuel is stored, and in particular the metal particles are preferably filled in contact with the outer side of the spent nuclear fuel.

In the interim storage container for spent nuclear fuel of the present invention, the main body is cylindrical, which plays a role of supporting the interim storage container for spent nuclear fuel and to secure the loading space.

In addition, the lid herein is connected to the top of the main body to seal the spent nuclear fuel.

In the interim storage container for spent nuclear fuel of the invention, the outer shell is equipped on the outer side of the main body, which is cylindrical. The neutron shielder is located in between the main body and the outer shell in order to block the neutrons.

In the interim storage container for spent nuclear fuel of the invention, the inner container is located in the inside of the main body, wherein multiple storage rooms are formed to store the spent nuclear fuel.

The spent nuclear fuel can be discharged from light water reactors or heavy water reactors, and the spent nuclear fuel may be present as an aggregate.

The storage room for spent nuclear fuel is filled with metal particles, by which excellent cooling performance is exhibited through the filled metal particles.

Particularly, the metal particle is one or more metals selected from the group consisting of boron (B), carbon (C), magnesium (Mg), aluminum (Al), silicon (Si), titanium (Ti), vanadium (V), chromium (Cr), manganese (Mn), iron (Fe), nickel (Ni), copper (Cu), zinc (Zn), yttrium (Y), zirconium (Zr), niobium (Nb), molybdenum (Mo), hafnium (Hf), tantalum (Ta), gold (Au), silver (Ag), platinum (Pt), and the alloys thereof, and more preferably the metal particle is selected from the group consisting of copper (Cu), zinc (Zn), aluminum (Al), magnesium (Mg), molybdenum (Mo), silicon (Si), carbon (C), zirconium (Zr), and the alloys thereof.

The particle size of the metal particle is preferably 0.1 mm~10 mm, more preferably 0.5 mm~5 mm, and most preferably 1 mm~3 mm. If the particle size of the metal particle is less than 0.1 mm, there is a problem that the economical efficiency is low due to the additional cost for particle processing. If the particle size exceeds 10 mm, the cooling efficiency is reduced due to the coarse particles.

For more efficient cooling, the storage room can be filled with particles with even particle size, but more preferably filled with particles with different particle sizes. Particularly, metal particles with the particle size of 0.1 mm~1 mm are mixed together with those particles with the particle size of 1 mm~10 mm. In that case, more efficient cooling can be achieved by locating the metal particles having smaller particle size inbetween the metal particles having bigger particle size.

The metal particle in this invention can be spherical or polyhedral. To accomplish more efficient cooling by decreasing the fraction of empty spaces that can reduce the thermal conductivity in the course of filling the metal particles, it is preferred for the metal particle to be in the form of sphere or polyhedron. Considering economical efficiency accomplished by reducing the weight of the particle, the metal particle can be in the form of solid or hollow.

Further, the thermal conductivity of the metal particle is preferably at least 1.0 W/cm·K, more preferably 1.0 W/cm·K~10.0 W/cm·K, and most preferably 1.2 W/cm·K~4.2 W/cm·K. The thermal conductivity has to be considered to efficiently cool the decay heat generated from the spent nuclear fuel filled in the empty space of the storage room for spent nuclear fuel. If the thermal conductivity of the metal particle is less than 1.0 W/cm·K, the decay heat generated from the spent nuclear fuel cannot be cooled down efficiently.

In addition, considering the long term storage of the spent nuclear fuel at a high temperature, the thermal stability of the metal particle filling in has to be considered. For example, the melting point is one factor to be considered. The melting point of the metal particle in this invention is preferably at least 500° C., and more preferably 500° C.~4000° C. Also, the metal particle is expected not to be changed in its phase at a temperature under the melting point. When the metal particle having a single phase without phase transformation at a temperature under the melting point is used, it can provides uniform cooling performance without physical property changes according to the long term storage.

Further, the neutron absorption rate of the metal particle is preferably $10^4$ neutron/cm~2 neutron/cm, and more preferably $2\times10^4$ neutron/cm~1 neutron/cm. Considering the characteristics of the spent nuclear fuel emitting neutrons and radiation, the degree of radio-activation of the metal particle is also an important factor to be considered. If the radio-activation caused by the emitted neutrons is excessive, the metal particles to be filled are treated as separate radioactive waste, which increases the amount of waste. However, when it is necessary to prevent the nuclear criticality of the spent nuclear fuel, it is possible to add an element that absorbs neutrons such as boron (B) to the metal particle material.

In addition, when the metal material absorbs neutrons, the atomic mass increases and could become unstable, and decay with radiation emission. To reduce the possibility of radio-activation, it is preferable that the atomic mass of stable isotopes of metal particle element is 0-3 higher (up to 3 times higher) than that of the reference isotope (an isotope having a highest existence ratio). Then the element of the metal particles can be still stable even after absorbing neutrons.

Before storing the spent nuclear fuel in the interim storage container, the process of eliminating the remaining moisture from the spent nuclear fuel is necessary. At this time, if the moisture is removed after filling the metal particles as designed in this invention, it is possible to prevent the temperature of the spent fuel from rising excessively during the moisture removal process in the conventional inert or vacuum atmosphere.

Further, the present invention provides a method for cooling the spent nuclear fuel during the period of interim storage comprising the following steps:

preparing an interim storage container for spent nuclear fuel composed of a cylindrical body; an inner container having multiple storage rooms for spent nuclear fuel that is located in the inside of the main body; a cylindrical outer shell equipped in the outside of the main body; a neutron shielder to block the neutrons located in between the main body and the outer shell; and a lid connected to the top of the main body (step 1); and filling the empty sections in the storage room with metal particles after loading the spent nuclear fuel in the storage room of the container prepared in step 1 (step 2).

Hereinafter, the method for cooling the spent nuclear fuel during the period of interim storage is described in more detail step by step.

First, in the method for cooling the spent nuclear fuel during the period of interim storage, step 1 is to prepare an interim storage container for spent nuclear fuel composed of a cylindrical body; an inner container having multiple storage rooms for spent nuclear fuel that is located in the inside of the main body; a cylindrical outer shell equipped in the outside of the main body; a neutron shielder to block the neutrons located in between the main body and the outer shell; and a lid connected to the top of the main body.

The interim storage container for spent nuclear fuel of the invention is as described above, so the description is omitted herein.

Next, in the method for cooling the spent nuclear fuel during the period of interim storage, step 2 is to fill the empty space of the storage room for spent nuclear fuel prepared in step 1 with metal particles.

According to the method for cooling the spent nuclear fuel of the invention, the heat generated from the spent nuclear fuel stored therein is directly delivered to the main body of the interim storage container by those metal particles and therefore the cooling efficiency is higher and the maintenance cost is lower than the conventional method using gas at high pressure.

Particularly, the metal particles herein are the combined metal particle mixture composed of the metal particles having the particle size of 0.1 mm-1 mm and the metal particles having the particle size of 1 mm-10 mm.

Practical and presently preferred embodiments of the present invention are illustrative as shown in the following Examples.

However, it will be appreciated that those skilled in the art, on consideration of this disclosure, may make modifications and improvements within the spirit and scope of the present invention.

<Experimental Example 1> Analysis of the Characteristics of Metal Particles

The characteristics of the metal particle applicable to the interim storage container for spent nuclear fuel of the invention were analyzed as follows.

For the selection of the metal particles, the first thing to consider is that the metal particle has to have a high thermal conductivity. Secondly, the metal particle has to have a high melting point. Thirdly, the metal particle has to have a low neutron absorptiveness. However, when it is necessary to prevent the nuclear criticality of the spent nuclear fuel, it is possible to add an element that absorbs neutrons such as boron (B) to the metal material.

(1) Analysis of Thermal Conductivity and Melting Point of Metal Particles

The thermal conductivity and melting point of boron (B), carbon (C), magnesium (Mg), aluminum (Al), silicon (Si), titanium (Ti), vanadium (V), chromium (Cr), manganese (Mn), iron (Fe), nickel (Ni), copper (Cu), zinc (Zn), yttrium (Y), zirconium (Zr), niobium (Nb), molybdenum (Mo), hafnium (Hf), tantalum (Ta), gold (Au), silver (Ag), and platinum (Pt) were analyzed. The results are shown in FIG. 1.

As shown in FIG. 1, the thermal conductivity of all of those metals was higher than that of helium. In particular, the thermal conductivity of copper (Cu), zinc (Zn), aluminum (Al), magnesium (Mg), silicon (Si), molybdenum (Mo), and carbon (C) was more excellent.

As shown in FIG. 1, copper (Cu), zinc (Zn), aluminum (Al), magnesium (Mg), silicon (Si), molybdenum (Mo), carbon (C), and zirconium (Zr) displayed higher melting points than 400° C. which is the maximum cladding temperature generated in the spent nuclear fuel. Aluminum (Al), magnesium (Mg), and zinc (Zn) displayed comparatively low melting points, compared with other materials. These materials have a single phase without phase transformation at a temperature under the melting point, and can exhibit uniform cooling performance without physical property changes caused by phase changes during the long term storage.

(2) Analysis of Neutron Absorptiveness of Metal Particles

The neutron absorptiveness of boron (B), carbon (C), magnesium (Mg), aluminum (Al), silicon (Si), titanium (Ti), vanadium (V), chromium (Cr), manganese (Mn), iron (Fe), nickel (Ni), copper (Cu), zinc (Zn), yttrium (Y), zirconium (Zr), niobium (Nb), molybdenum (Mo), hafnium (Hf), tantalum (Ta), gold (Au), silver (Ag), and platinum (Pt) was analyzed. The results are shown in FIG. 2.

Considering that the spent nuclear fuel has the characteristics of emitting neutrons and radiation, the radio-activation degree of the particle material is also an important factor to consider. If the radio-activation caused by neutron irradiation is excessive, the used metal particles are treated as separate radioactive waste, which increases the amount of waste.

Figure 2:
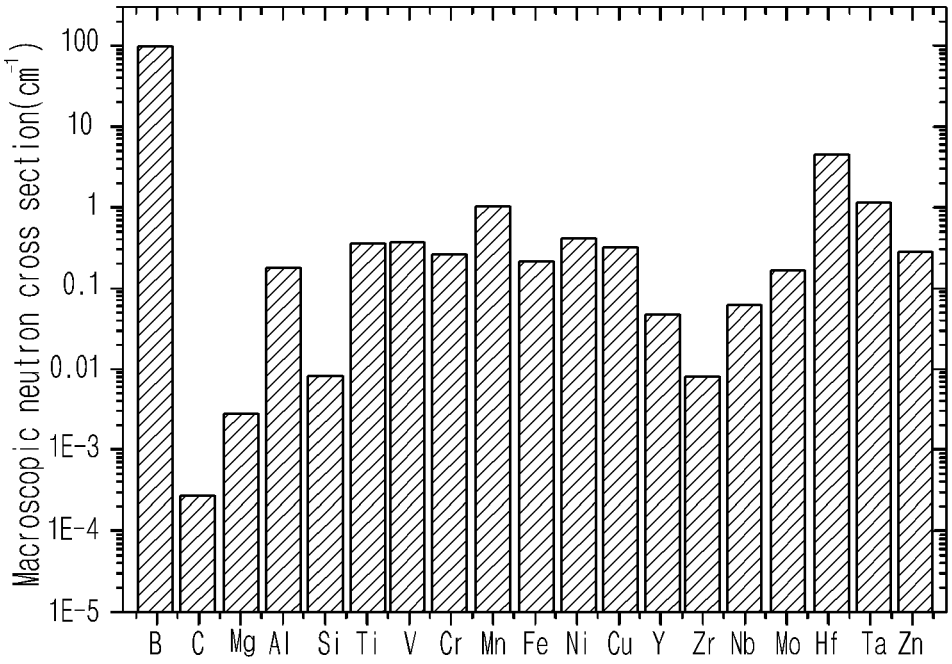
FIG. 2 is a graph illustrating the neutron absorption property of metal particle elements.

As shown in FIG. 2, copper (Cu), zinc (Zn), aluminum (Al), magnesium (Mg), silicon (Si), molybdenum (Mo), carbon (C), and zirconium (Zr) were confirmed to have a low neutron absorptiveness.

(3) Analysis of Element Component Ratio and Radiation Behavior According to Atomic Mass of Metal Particles The atomic masses of the isotopes and their radio-activation by neutron irradiation such as boron (B), carbon (C), magnesium (Mg), aluminum (Al), silicon (Si), titanium (Ti), vanadium (V), chromium (Cr), manganese (Mn), iron (Fe), nickel (Ni), copper (Cu), zinc (Zn), yttrium (Y), zirconium (Zr), niobium (Nb), molybdenum (Mo), hafnium (Hf), tantalum (Ta), gold (Au), silver (Ag), and platinum (Pt) were analyzed. The results are shown in FIG. 3.

The element dependent activation is also an important factor to consider along with the neutron absorptiveness. In general, if an element absorbs a neutron, the atomic mass of the element increases, making the element unstable, later decaying with radiation emission. To reduce the possibility of radio-activation, the atomic mass of a stable isotope for each element is preferably higher than the atomic mass of a reference element (with the highest existence ratio).

As shown in FIG. 3, the stable isotope for copper (Cu), zinc (Zn), aluminum (Al), magnesium (Mg), silicon (Si), carbon (C), and zirconium (Zr) was distributed on the higher position than the atomic mass of an element having the highest existence ratio. In the case of molybdenum (Mo), the isotope was distributed on a lower position than the atomic mass of an element having the highest existence ratio, but the distribution was relatively even so that the radio-activation degree according to the increased atomic mass might be low.

<Experimental Example 2>

The following experiment was performed to prove the effect of the present invention.

Figure 4:
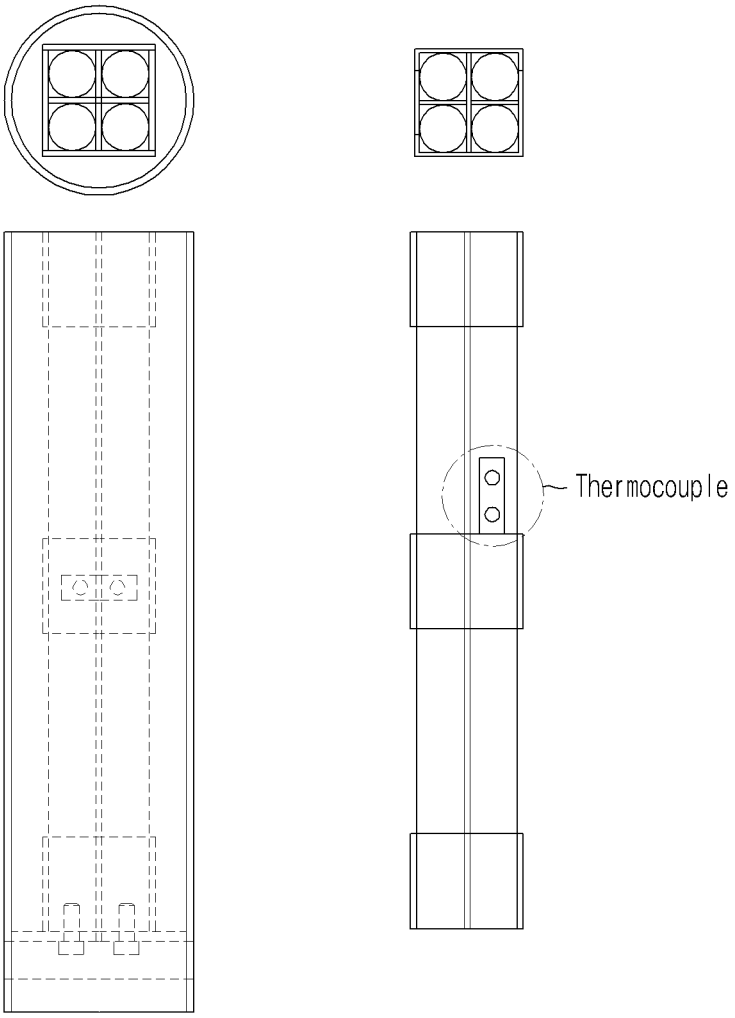
FIG. 4 is a schematic diagram illustrating the interim storage container for spent nuclear fuel according to an example of the present invention.

A dry storage container, which is a stainless steel structure imitating the nuclear fuel aggregate, was constructed as shown in FIG. 4. To evaluate the surface temperature of the nuclear fuel during cooling, a thermocouple was installed on the outer surface of the stainless steel rod. The particles used for the experiment were pure copper particles having the particle size of 1.18 mm-2.36 mm.

The dry storage container was placed in a 400° C. heating furnace to perform thermal equilibrium. The dry storage container was taken out and filled with copper particles, followed by cooling in the air in Example 1. In Example 2, the dry storage container was filled with copper particles first, and then placed in a 400° C. heating furnace, followed by thermal equilibrium. Then, the dry storage container was taken out and cooled down in the air.

In a Comparative Example, the dry storage container was placed in a 400° C. heating furnace without being filled with copper particles, followed by thermal equilibrium. Then, the dry storage container was cooled down in the air.

Figure 5:
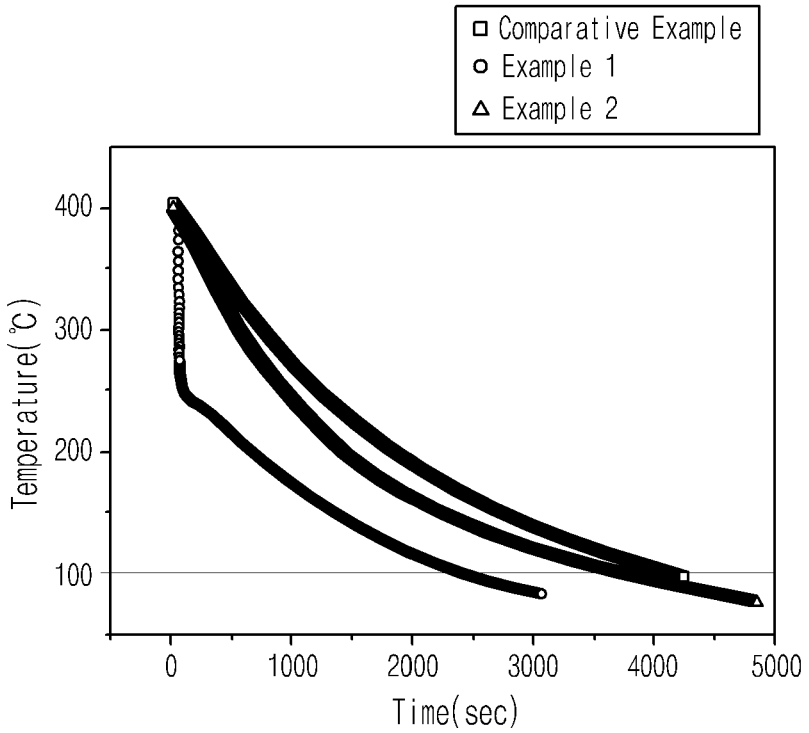
FIG. 5 is a graph illustrating the cooling of the outer side of the interim storage container measured in Example 1, Example 2, and the Comparative Example of the present invention.

The cooling curve of the outer surface of the stainless steel rod according to each of the Examples and the Comparative Example is shown in FIG. 5.

In the case of Example 1, it was observed that the cooling performance over the time was improved as compared with the case of cooling without copper particles.

The time required for cooling from 400° C. to 100° C. took 2475 seconds in the case of Example 1, 3649 seconds in the case of Example 2 and 4127 seconds in the case of Comparative Example. Therefore, it was confirmed that the cooling efficiency was improved by at most 40% as compared with the Comparative Example.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended Claims.

What is claimed is:

1. An interim storage container containing spent nuclear fuel, wherein the storage room for spent nuclear fuel is filled with metal particles, wherein the metal particles do not undergo a phase transformation or change physical properties in the container, and the particles provide efficient cooling performance during storage of the spent nuclear fuel.

2. The interim storage container for spent nuclear fuel according to claim 1, wherein the metal particle is one or more metals selected from the group consisting of copper (Cu), zinc (Zn), aluminum (Al), magnesium (Mg), molybdenum (Mo), silicon (Si), carbon (C), zirconium (Zr), and the alloys thereof.

3. The interim storage container for spent nuclear fuel according to claim 1, wherein the particle size of the metal particle is 0.1 mm-10 mm.

4. The interim storage container for spent nuclear fuel according to claim 1, wherein the metal particle is in the shape of sphere or polyhedron.

5. The interim storage container for spent nuclear fuel according to claim 1, wherein a neutron material including boron (B) is added to the metal particle for the prevention of the nuclear criticality of the spent nuclear fuel.

6. The interim storage container for spent nuclear fuel according to claim 1, wherein an atomic mass of an isotope included in the metal particle at the percentage of 0.1-99.9% is up to 3 times higher than an atomic mass of an element having the highest existence ratio in the metal particle.

7. The interim storage container for spent nuclear fuel according to claim 1, wherein the metal particle is in the form of solid or hollow.

8. The interim storage container according to claim 7, wherein the metal particles comprise hollow metal particles.

9. The interim storage container according to claim 1, wherein the metal particles are of different particle sizes to achieve more efficient cooling during storage.

10. The interim storage container according to claim 1, wherein the metal particles are recoverable from the container and the particles re-usable.

11. The interim storage container according to claim 1, wherein the metal particles are copper metal particles.

12. An interim storage container for spent nuclear fuel comprising:

a cylindrical body;

an inner container having multiple storage rooms for spent nuclear fuel that is located in the inside of the main body;

a cylindrical outer shell on the outside of the main body;

a neutron shield to block the neutrons wherein the neutron shield is located between the main body and the outer shell; and a lid connected to the top of the main body, and wherein metal particles are contained in the storage rooms for spent nuclear fuel, wherein the metal particles do not undergo a phase transformation or change physical properties in the container, and the particles provide efficient cooling performance during storage of the spent nuclear fuel.

13. The interim storage container for spent nuclear fuel according to claim 12, wherein the metal particles are contacting the spent nuclear fuel.

14. The interim storage container for spent nuclear fuel according to claim 12, wherein the spent nuclear fuel is generated from light water reactors or heavy water reactors.

15. A method for cooling spent nuclear fuel during a period of interim storage, comprising the following steps:

(a) preparing an interim storage container for spent nuclear fuel composed of a cylindrical body; an inner container having multiple storage rooms for spent nuclear fuel that is located in the inside of the main body; a cylindrical outer shell on the outside of the main body; a neutron shield to block the neutrons wherein the neutron shield is located between the main body and the outer shell; and a lid connected to the top of the main body; and (b) filling the empty sections in the storage room with metal particles before, during or after loading the spent nuclear fuel in the storage room of the container prepared in step (a);

storing the spent nuclear fuel in the presence of the metal particles, without the metal particles undergoing a phase transformation or change of physical properties in the container, and the particles provide efficient cooling performance during storage of the spent nuclear fuel in the interim storage container.

16. The method for cooling the spent nuclear fuel during the period of interim storage according to claim 15, wherein the heat generated from the spent nuclear fuel stored in the container is directly delivered to the main body of the interim storage container by the metal particles.

17. The method for cooling the spent nuclear fuel during the period of interim storage according to claim 15, wherein the metal particles are a combined metal particle mixture composed of metal particles having a particle size of 0.1 mm-1 mm and metal particles having a particle size of 1 mm-10 mm.

18. The method for cooling the spent nuclear fuel during the period of interim storage according to claim 15, wherein before storing the spent nuclear fuel in the interim storage container, remaining moisture from the spent nuclear fuel is removed from the storage container after filling the storage container with metal particles.

19. The method for cooling the spent nuclear fuel during the period of interim storage according to claim 15, wherein the metal particles filling the container are recoverable from the container.

20. The interim storage container according to claim 15, wherein the metal particles and spent nuclear fuel are removed from the interim container.

* * * * *